US005515660A

United States Patent [19]

Hanks et al.

[11] Patent Number: 5,515,660

[45] Date of Patent: May 14, 1996

[54] WALL STUD AND NOGGING

[75] Inventors: Paul D. Hanks, Corrimal New South Wales; James C. Adams, Dapto, both of Australia

[73] Assignee: BHP Steel (JLA) Pty. Ltd., Sydney NSW, Australia

[21] Appl. No.: 261,916

[22] Filed: Jun. 16, 1994

[30] Foreign Application Priority Data

Jun. 25, 1993 [AU] Australia ..... PL9610

[51] Int. Cl.[6] ..... F04C 2/32

[52] U.S. Cl. ..... 52/667; 52/481.2

[58] Field of Search ..... 52/481.1, 481.2, 52/483.1, 489.1, 489.2, 664, 667

[56] References Cited

U.S. PATENT DOCUMENTS

| | | | |
|---|---|---|---|
| 2,640,570 | 6/1953 | Horowitz | 52/667 |
| 4,850,169 | 7/1989 | Burkstrand | 52/481.1 X |
| 5,274,973 | 1/1994 | Liang | 52/667 X |
| 5,327,695 | 7/1994 | Kelly | 52/667 X |

FOREIGN PATENT DOCUMENTS

| | | | |
|---|---|---|---|
| 9323636 | 11/1993 | Australia | 52/483.1 |

*Primary Examiner*—Carl D. Friedman
*Assistant Examiner*—Yvonne Horton-Richardson
*Attorney, Agent, or Firm*—Nikaido Marmelstein Murray & Oram

[57] ABSTRACT

A generally channel sectioned wall stud 7 which has been cold roll-formed from a sheet metal strip comprises a web 8 and two flanges 9. The web 8 has a substantial central strip that is planar. A nogging clearance hole 10, is provided in the central strip of the web 8 at each point where a nogging 11 is to be affixed thereto. The nogging 11 may be roll-formed from material the same as or similar to that of the stud 7 and is also generally channel sectioned, comprising a web 12, with a flat ended central rib 13 formed therein and flanges 14. The web 12 is pierced by clearance slots 15 arranged in two rows extending longitudinally of the nogging 11. The individual slots 15 are regularly spaced apart along the rows. The nogging clearance hole 10 is shaped to suit the nogging 11. To that end it is partly defined by two tabs 16 projecting from the web 8 and lying in the plane of its central strip 13. Each tab 16 is able to enter any one of the holes 15, and the tabs are spaced apart (center to center) by substantially the same distance as are the two rows of holes 15. Thus the tabs 16 may simultaneously enter each of any pair of holes 15 at corresponding locations in their respective rows.

3 Claims, 2 Drawing Sheets

WALL STUD AND NOGGING

TECHNICAL FIELD

This invention relates to wall frames of the kind fabricated from a plurality of elongate structural members, namely a substantially horizontal floor plate, a substantially horizontal roof or ceiling plate spaced above the floor plate, a plurality of upright, spaced apart studs extending from plate to plate, and a plurality of spaced apart substantially horizontal noggings extending from each stud to its neighbouring stud or studs.

More particularly the invention relates to such frames for use in low rise buildings, for example one or two story domestic dwellings, wherein the frames are relatively lightly loaded and the frame members may be partially or fully manufactured from cold roll-formed strips of light gauge sheet metal, for example galvanised steel.

BACKGROUND ART

In the construction of such buildings every effort is made to keep costs down, and this extends not only to the materials of the wall frames but also to the labour involved in assembling and erecting the frames. A substantial part of the labour resides in the affixture of the many noggings to the studs.

Traditionally the noggings have been comparable to the studs in cross-sectional shape end size, if only to permit the noggings to be secured to the studs by conventional fasteners such as self-tapping screws or the like. This is so notwithstanding that the noggings are only lightly loaded axially (that is in longitudinal tension or compression) in comparison with the other frame members being called upon only to control lateral and torsional movement of the studs, such as would lead to buckling thereof, rather than to resist the main weight loads or flexural wind loads imposed on the frames. Indeed the greatest stresses likely to be imposed on the noggings throughout their life are bending stresses due to the weight of persons using them as ladders widen working on the building before the walls are clad, even though designing noggings for the weight of a person Is not a design code requirement.

DISCLOSURE OF INVENTION

The present invention takes advantage of the relatively light axial loading on the noggings to provide a nogging and stud combination wherein the nogging uses less material than conventional noggings and, more importantly, wherein the nogging may be affixed to the stud, or to a sheet metal component part thereof if the stud or section thereof is a composite of different materials, simply and quickly without the need for skill on the part of the assembler, and without the need for separate or special fasteners.

The invention consists in a wall stud comprising a sheet metal web, characterised in that said web is pierced by a nogging clearance hole through which a nogging may extend, and in that said clearance hole is partly defined by at least one tab integral with the web and projecting therefrom.

In use, a sheet metal nogging that is pierced by a tab clearance orifice, extends through said clearance hole in the stud and the tab on the stud extends through the orifice in the nogging so as to prevent substantial movement of the stud relative to the nogging in the longitudinal direction of the nogging.

The invention also consists in the combination of a sheet metal wall stud according to the invention and a nogging extending through the clearance hole in the stud with the tab of the stud extending through an orifice in the hogging.

BRIEF DESCRIPTION OF THE DRAWINGS

By way of example, two embodiments of the above described invention are described hereinafter with reference to the accompanying drawings.

BEST MODE OF CARRYING OUT THE INVENTION

Figure 4:
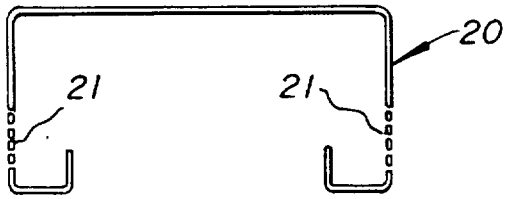
FIG. 4 is a view similar to FIG. 2 of another nogging useable in combination with other studs according to the invention.
Figure 2:
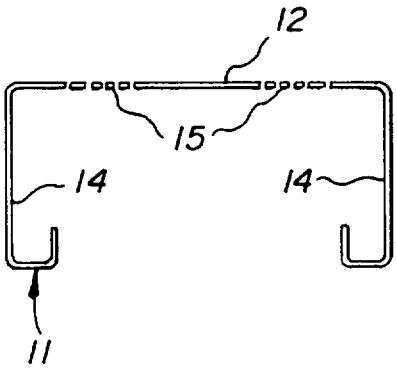
FIG. 2 is a cross-sectional view of a nogging useable in combination with the stud of FIG. 1.
Figure 1:
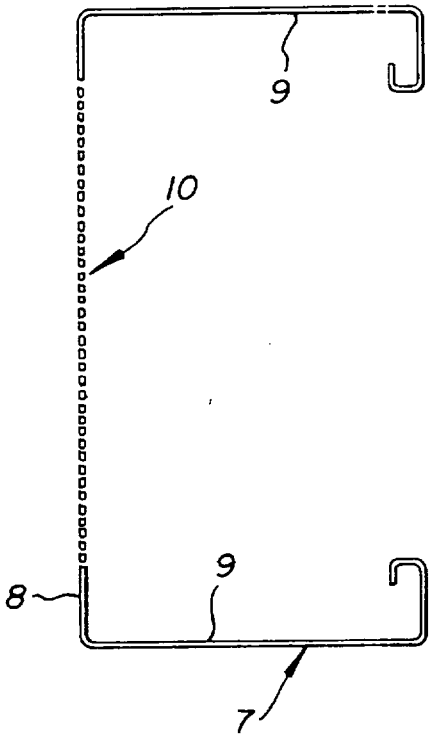
FIG. 1 is a cross-sectional view of a wall stud according to the invention.
Figure 3:
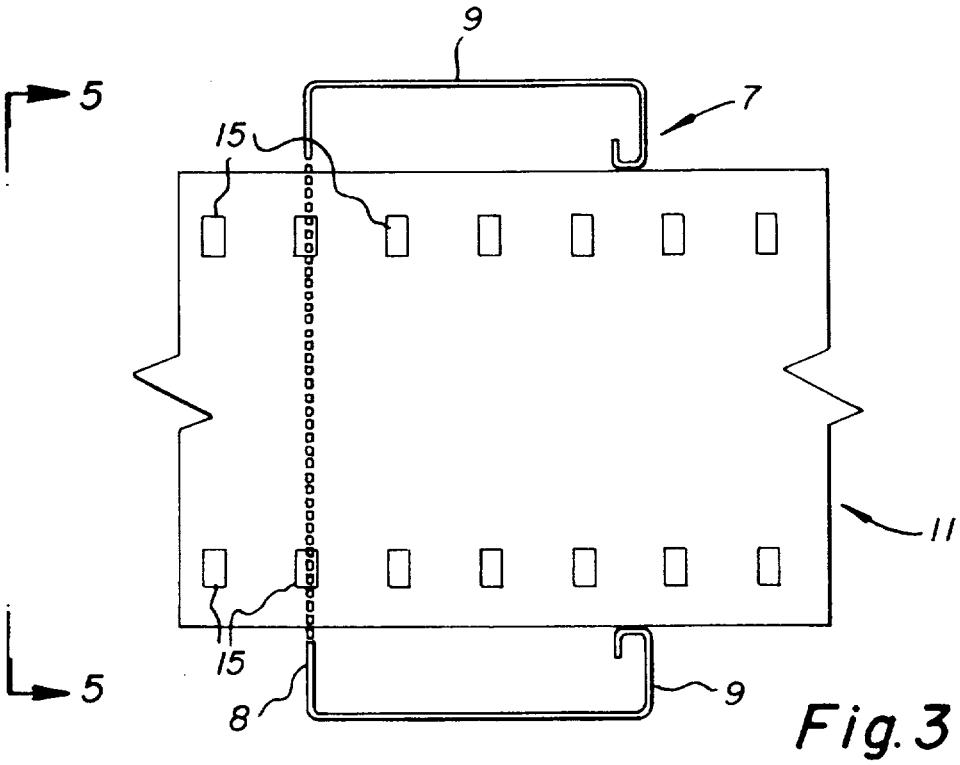
FIG. 3 is a plan view of the stud of FIG. 1 in combination with the nogging of FIG. 2.

The embodiment illustrated by FIGS. 1, 2, 3 and 5 comprises a generally channel sectioned wall stud 7 which has been cold roll-formed from a sheet metal strip, for example a strip of steel coated with zinc or an alloy of aluminium and zinc. The stud 7 comprises a web 8 and two flanges 9. The web 8 and flanges 9 may be shaped with ribbed or grooved main parts and, in the case of the flanges, with subsidiary edge flanges, to enhance their stiffness.

In accordance with the invention a nogging clearance hole 10 is provided in the web 8 at each point where a nogging 11 is to be affixed thereto.

The nogging 11 may be roll-formed from material the same as or similar to that of the stud 7. It is also generally channel sectioned, comprising a web 12 and flanges 14. The web 12 is pierced by clearance orifices in the form of slots 15 arranged in two rows extending longitudinally of the hogging 11. The individual slots 15 are regularly spaced apart along the rows.

The nogging clearance hole 10 is shaped to suit the nogging 11. To that end it is partly defined by two tabs 16 projecting from the web 8 and lying in the plane thereof. Each tab 16 is able to enter any one of the slots 15, and the tabs are spaced apart (center to center) by substantially the same distance as are the two rows of slots 15. Thus the tabs 16 may simultaneously enter each of any pair of slots 15 at corresponding locations in their respective rows. For preference each tab 16 is tapered, or round ended at the tip, to facilitate its initial entry into a slot 15. Furthermore it has a nogging retainer notch, or is otherwise shaped, as at 17, at some distance from its tip to provide a retaining effect once it has entered a slot 15 by a greater distance. The tabs are tapered such that they will flex towards each other as a downward force is applied to the nogging and will spring back after the notch passes through the nogging slots. The notches will then prevent the nogging from being dislodged when being transported or in service.

The nogging clearance hole 10 is further suited to the nogging 11 in that the nogging may be passed through the hole, with its web 12 clear of the tabs 16, and then moved laterally to cause the tabs 16 to fully enter a selected pair of slots 15, whereupon the nogging flanges 14 fit neatly within the confines of the hole 10 and make contact with the web 8 at 18. Thus the stud 7 is effectively secured to the nogging 11 and the latter is effectively prevented from twisting about its longitudinal axis by the stud, all without need for skill on the part of the person assembling the wall frame or the provision of separate fasteners.

In practice, the studs would preferably be prefabricated, with hogging clearance holes at appropriate positions along their length, before delivery to the building site. Also the nogging members may be prefabricated as custom made elements of the particular wall frame for which they are intended. In that event the hogging member may extend for the full length of the frame, and may only be slotted at positions corresponding to those of the studs. On the other hand the noggings may be provided as stock material intended to be cut to length at site. In this event it is preferred for the stock material to be slotted as shown, so that appropriately positioned slots may be selected from the plurality available.

Figure 6:
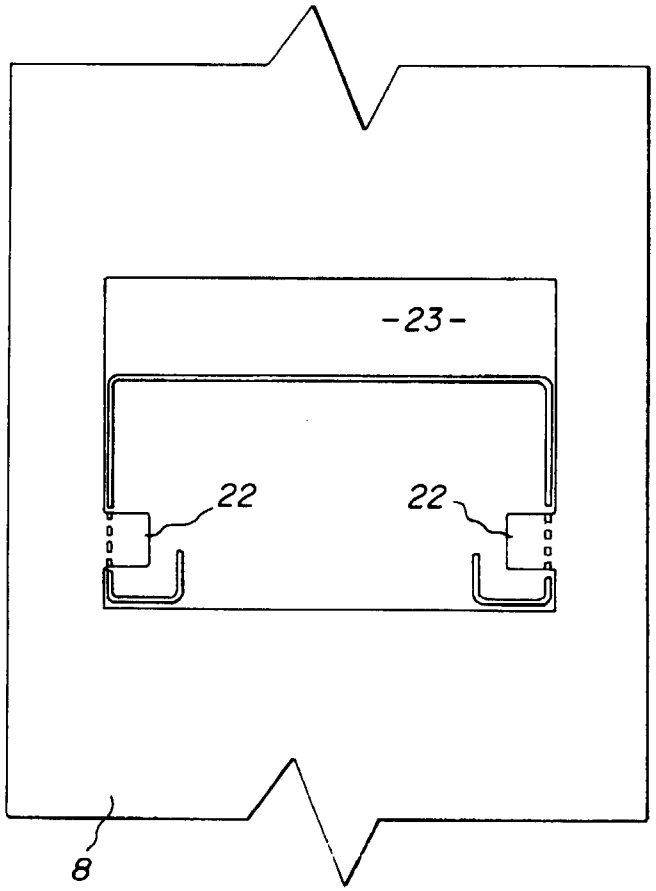
FIG. 6 is a view similar to FIG. 5 of another combination according to the invention including the nogging of FIG. 4.
Figure 5:
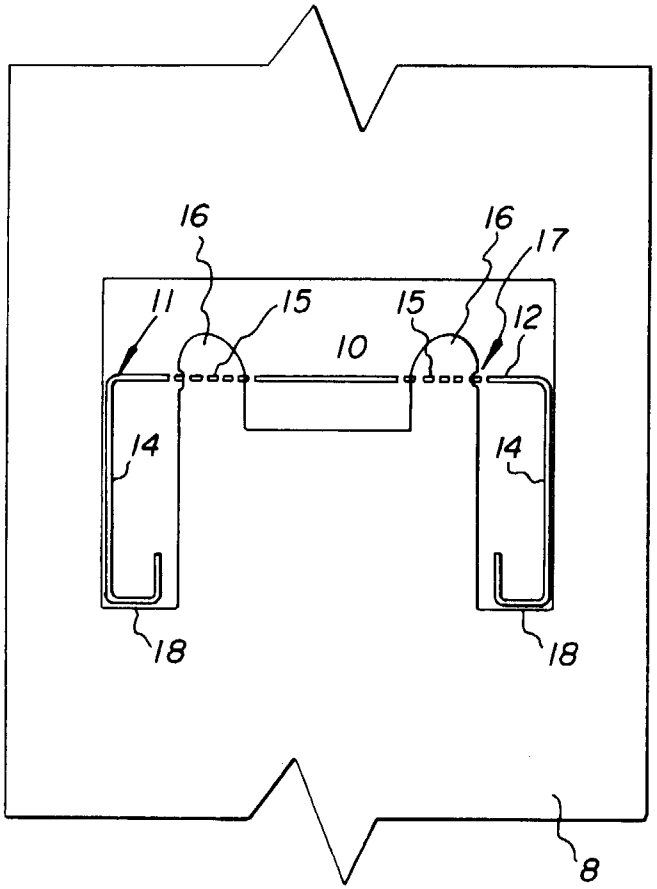
FIG. 5 is a detail view taken on line 5—5 of FIG. 3, drawn to a larger scale.

The embodiment illustrated by FIGS. 4 and 6 is similar in concept to the first described embodiment and need not be described in detail. It differs from the first described embodiment primarily in the shape of the nogging clearance hole and the positioning of the tabs of the stud and the tab clearance slots of the nogging.

Thus a nogging 20 of inverted channel section has its clearance slots 21 formed in its channel flanges, and a stud, which apart from the shape of its nogging clearance holes may be the same as stud 7, has its tabs 22 projecting into the sides of generally rectangular clearance holes 23.

To some extent this second described embodiment is more advantageous than the first as it provides for a somewhat more positive retention of the nogging to the stud. The flanges of the nogging can be sprung together by hand to insert the tabs, and the flexural rigidity of the flanges then prevents the nogging from being dislodged when being transported or in service.

In each embodiment the nogging and stud are preferably sized such that the nogging fits snugly between the lipped flange of the stud section. The nogging thereby provides some torsional restraint to the stud cross-section.

We claim:

1. A system comprising a substantially upright sheet metal wall stud and a substantially horizontally extending nogging wherein;

the stud has a channel section comprising a channel web and two channel flanges, the channel web has a substantially planar, and substantially central strip, the central strip is pierced by a nogging clearance hole having an upper edge and a lower edge, at least one tab located on the channel web, wherein said at least on tab lies in a plane of the channel web and projects part way across the nogging clearance hole from a periphery thereof, the at least one tab has substantially parallel side edges extending from the periphery of the nogging clearance hole, and a tip remote from said periphery, the nogging is pierced by at least one orifice, the nogging and the nogging clearance hole are so shaped and sized that the nogging when contacting said upper edge may be freely inserted through the nogging clearance hole without obstruction from the at least one tab and then may be translated laterally of itself to contact said bottom edge, the at least one tab extends through the orifice in the nogging to prevent substantial longitudinal movement of the nogging relative to the stud.

2. A system according to claim 1 wherein the stud comprises two tabs, the nogging has two rows of said orifices extending longitudinally of the nogging with the individual orifices regularly spaced apart along the rows, and the two tabs are spaced apart substantially a same distance as are the two rows of orifices, whereby each tab is able to enter any one of said orifices in a respective row.

3. A system according to claim 1 wherein the nogging is of inverted channel section having a said orifice formed in each of its channel flanges, and the stud has two said tabs projecting towards one another from opposite sides of the nogging clearance hole.

* * * * *